US009745085B2

(12) United States Patent
Pawlowski

(10) Patent No.: US 9,745,085 B2
(45) **Date of Patent: *Aug. 29, 2017**

(54) APPARATUS, SYSTEM AND METHOD FOR CHANGING A VOLUME

(76) Inventor: Mark Pawlowski, Chicago, IL (US)

( * ) Notice: Subject to any disclaimer, the term of this patent is extended or adjusted under 35 U.S.C. 154(b) by 2312 days.

This patent is subject to a terminal disclaimer.

(21) Appl. No.: 11/299,420

(22) Filed: Dec. 12, 2005

(65) Prior Publication Data

US 2007/0131681 A1 Jun. 14, 2007

(51) Int. Cl.
*B65D 6/00* (2006.01)
*B65B 3/04* (2006.01)
*B65D 8/00* (2006.01)

(52) U.S. Cl.
CPC ..... *B65B 3/04* (2013.01); *B65D 11/04* (2013.01)

(58) Field of Classification Search
USPC ..... 220/8, 4.26; 73/429; 285/182; 206/218; 426/111; 215/11.1
See application file for complete search history.

(56) References Cited

U.S. PATENT DOCUMENTS

| | | | | |
|---|---|---|---|---|
| 475,231 | A | 5/1892 | Anderson | |
| 2,326,414 | A | 8/1943 | Thompson | |
| 2,416,142 | A | 2/1947 | Bennett | |
| 2,887,243 | A * | 5/1959 | Murdock, Sr. | 220/8 |
| 2,904,209 | A * | 9/1959 | Murdock, Sr. | 220/8 |
| 3,134,264 | A | 5/1964 | Miller | |
| 3,659,108 | A * | 4/1972 | Quase | 250/506.1 |
| 4,112,634 | A * | 9/1978 | Bissinger | 52/67 |
| 4,116,071 | A | 9/1978 | Sakura | |
| 4,456,134 | A * | 6/1984 | Cooper | 215/341 |
| 5,078,287 | A * | 1/1992 | Holmes, III | 215/11.1 |
| 5,158,546 | A * | 10/1992 | Haber et al. | 604/87 |
| 5,422,129 | A | 6/1995 | Draddy | |
| 5,562,518 | A * | 10/1996 | Estrada | 446/5 |
| 5,632,406 | A * | 5/1997 | Robbins, III | 220/666 |
| 5,799,808 | A * | 9/1998 | Oh | 215/11.1 |
| 5,850,908 | A * | 12/1998 | Jasek | 220/203.23 |
| 5,930,951 | A | 8/1999 | Wong | |
| 6,026,685 | A * | 2/2000 | Weterrings et al. | 73/429 |
| 6,041,979 | A | 3/2000 | Robbins, III et al. | |
| 6,116,439 | A | 9/2000 | Yaniv | |
| 6,276,547 | B1 | 8/2001 | Petryna | |
| 6,783,031 | B2 | 8/2004 | Robbins et al. | |

(Continued)

*Primary Examiner* — Shawn M Braden
(74) *Attorney, Agent, or Firm* — Lempia Summerfield Katz LLC

(57) ABSTRACT

An apparatus, a system and a method for changing a volume are provided. More specifically, a system and a method for changing a volume of a container are provided. The container has an initial height defined between a top end and a bottom end. The container has a first section, a second section and/or a third section. The second section of the container is insertable into the first section and/or the third section. The first section and/or the third section is insertable into the second section of the container. The container holds contents, such as, solids, liquids or gases. The container seals the contents from an environment external to the container. As the contents of the container are removed from the container, the environment may fill the container. The first section, the second section and/or the third section may move to change the volume of the container to remove the environment from the container.

20 Claims, 2 Drawing Sheets

(56) References Cited

U.S. PATENT DOCUMENTS

| | | | | |
|---|---|---|---|---|
| 7,168,583 | B2 * | 1/2007 | Freeman | 220/8 |
| 2004/0169040 | A1 * | 9/2004 | Berbrich et al. | 220/8 |
| 2004/0232016 | A1 * | 11/2004 | Dietrich | 206/315.3 |

* cited by examiner

APPARATUS, SYSTEM AND METHOD FOR CHANGING A VOLUME

BACKGROUND OF THE INVENTION

The present invention generally relates to an apparatus, a system and a method for changing a volume. More specifically, the present invention relates to a system and a method for changing a volume of a container.

The container may have an interior defined between a top end and a bottom end. The container may store and/or may hold contents, for example, solids, gases and/or liquids. The contents may have a volume within the container. The container may have a thickness defined between an outer surface and an inner surface. The inner surface may define the volume of the container between the top end and the bottom end. The contents of the container may contact the inner surface of the container. The outer surface of the container may separate the contents of the container from an environment external to the container. The environment may be the atmosphere, liquids, gases and/or solids external to the container. As the contents of the container are used and/or removed from the container, the volume of the contents may decrease, and the environment may fill the volume of the container.

The container may have one or more sections and/or one or more portions between the top end and the bottom end of the container. The sections and/or the portions may be moved to change the initial volume of the container to an intermediate volume. The intermediate volume may be less than the initial volume. As a result, an amount of the environment in the intermediate volume of the container may be less than the amount of environment in the initial volume of the container.

It is generally known to use a container to store and/or to hold solids, gases and/or liquids. The container, such as, for example, a paint can or a water bottle, has a fixed volume. The container may have contents within the volume of the container, such as, for example, paint or water within a paint can or a water bottle, respectively. The contents may have a first volume which may be the same as the volume of the container. In such a case, the container is generally considered "filled". A portion of the first volume of the contents are used and/or removed from the container to decrease the first volume to a second, smaller volume. As a result, an amount of space may form within the volume of the container. The space within the container may be filled by the atmosphere and/or other substances exterior to the container. The atmosphere and/or other substances may have qualities and/or characteristics which may spoil, ruin and/or damage the contents of the container.

A large container is often used to store and/or to hold contents. When a portion of the contents of the large container are used and/or removed, a small container is often used to store and/or to hold the contents of the container. The contents of the large container must be transferred to the small container. Transferring the contents from the large container to the smaller container is inefficient. In addition, multiple transfers must be conducted to keep the contents of the large container in a container of suitable size. Volumes of the small container and the large container are fixed and incapable of being decreased as contents are being used and/or removed.

A need, therefore, exists for an apparatus, a system and a method for changing a volume. Additionally, a need exists for a system and a method for changing a volume of a container having sections and/or portions which may move to change the volume. Further, a need exists for a system and a method for changing a volume of a container which may remove environment by decreasing the volume of the container. Still further, a need exists for a container wherein the container has a first portion insertable and/or receivable into a second portion of the container. Moreover, a need exists for a system and a method for changing a volume of a container which may have a first section insertable and/or receivable into a second section and a third section insertable into the second section. Furthermore, a need exists for a system and a method for changing a volume of a container to protect and/or to preserve contents of the container. In addition, a need exists for a system and a method for changing a volume of a container with a ring or other device which may seal a section of the container.

SUMMARY OF THE INVENTION

The present invention relates to an apparatus, a system and a method for changing a volume. More specifically, the system and the method may change a volume of a container. The container may have a height defined between a top end and a bottom end. The container may have a number of portions and/or a number of sections. Each portion and/or each section of the container may move to change the height and/or the volume of the container. The container may have an inner surface and an outer surface. The inner surface of the container may seal and/or may fasten, for example, a first section to a second section to change the height and/or the volume of the container. The container may hold and/or may store a volume of contents which may be liquids, gases and/or solids. The top end of the container may have a cap which may close and/or may shut to prevent the contents within the container from exiting the container. The cap may close and/or may shut the container to prevent any substance exterior to the container from entering the volume of the container. The cap may be removed to use and/or to remove the contents of the container. As the contents are used and/or removed from the volume of the container, a substance exterior to the volume of the container may enter the container. Each section and/or each portion may move from a first position to a second position to move, to force and/or to remove the substance from the volume of the container. The cap may have a vent to release the substance from the volume of the container as the volume of the container decreases to force the substance from the interior of the container.

To this end, in an embodiment of the present invention, an apparatus for storing contents within a volume is provided. The apparatus has a first section having a top end and a bottom end wherein the bottom end is opposite to the top end wherein the first section has an interior surface and an exterior surface and further wherein the first section has a first volume defined between the top end, the bottom end and the interior surface wherein the first volume stores the contents. Further, the apparatus has a second section connected to the first section wherein the second section has a distal end and a proximate end wherein the second section has an outer surface and an inner surface wherein the second section has a second volume wherein the second volume and the first volume form the volume to store the contents and further wherein the first section inserts into the second section to decrease the volume to the first volume and further wherein the first section is sealed from the second section.

In an embodiment, the apparatus has a ring connected to the bottom end of the first section wherein the ring abuts the second section to seal the first section from the second section.

In an embodiment, the apparatus has threads on the first section and the second section wherein the threads of the first section engage the threads of the second section to connect the first section to the second section.

In an embodiment, the apparatus has a lip integrally formed with the first section wherein the lip abuts the second section to seal the first section from the second section.

In an embodiment, the apparatus has a notch on the second section wherein the notch abuts the first section to seal the first section from the second section.

In an embodiment, the apparatus has a third section connected to the second section wherein the third section is sized to receive the second section.

In another embodiment of the present invention, a system for storing contents within a volume. The system has a container having an initial height defined between a top end and a bottom end. Further, the container has a first section defined between the top end of the container and the first end. Still further, the container has a second section defined between the first end and a second end wherein the second section is sized to receive the first section wherein the first section is sealed from the second section. Moreover, the container has a third section defined between a second end and the bottom end wherein the third section is sized to receive the first section and the second section wherein the second section seals from the third section and further wherein the first end is insertable into the second end to decrease the initial height to an intermediate height and further wherein the second end is insertable into the third end to decrease the height to a final height and further wherein the volume of the container at the intermediate height is greater than the volume at the final height.

In an embodiment, the system has a ring located at the bottom end of the first section wherein the ring abuts the second section to seal the first section from the second section.

In an embodiment, the system has threads on the first section and the second section wherein the threads of the first section engage the threads of the second section to connect the first section to the second section.

In an embodiment, the system has a lip integrally formed with the first section wherein the lip abuts the second section to seal the first section from the second section.

In an embodiment, the system has a notch on the second section wherein the notch abuts the first section to seal the first section from the second section.

In an embodiment, the system has a cap removably attached to the top end of the container wherein the cap engages the top end of the container to seal the container.

In an embodiment, the system has an opening on the top end of the container wherein the opening extends from an exterior of the container to an interior of the container.

In another embodiment of the present invention, a method for storing contents within a volume is provided. The method has the step of providing a container having a height defined between a top end and a bottom end wherein the top end is opposite to the bottom end wherein the container has a first section and a second section wherein the first section has an exterior surface wherein the second section has an interior surface. Further, the system has the step of inserting the first section into the second section. Still further, the system has the step of connecting the exterior surface of the first section to the interior surface of the second section. Moreover, the system has the step of sealing the first section from the second section. Furthermore, the system has the step of moving the first section toward the bottom end of the container to decrease the height and the volume of the container.

In an embodiment, the method has the step of inserting a ring between the first section and the second section wherein the ring seals the first section from the second section.

In an embodiment, the method has the step of integrally forming a lip to the first section to removably attach the first section to the second section.

In an embodiment, the method has the step of forming a notch on the second section wherein the notch seals the first section from the second section.

In an embodiment, the method has the step of removably attaching a cap to the top end of the container.

In an embodiment, the method has the step of providing an opening on the top end of the container wherein the opening extends from the interior surface to the exterior surface.

In an embodiment, the method has the step of connecting a third section to the second section wherein the third section is sized to receive the second section.

It is, therefore, an advantage of the present invention to provide an apparatus, a system and a method for changing a volume.

Another advantage of the present invention is to provide a container having a number of sections and/or a number of portions which move to change a volume of the container.

And, another advantage of the present invention is to provide a system and a method for changing a volume of a container which may remove air from the volume of the container by decreasing the volume of the container.

Yet another advantage of the present invention is to provide a container having a first portion insertable into a second portion of the container.

A further advantage of the present invention is to provide a system and a method for changing a volume of a container via threads which may connect a first portion of a container to a second portion of a container.

Moreover, an advantage of the present invention is to provide a system and a method for changing a volume of a container to at least a first volume, a second volume and a third volume.

And, another advantage of the present invention is to provide a system and a method for preserving contents of a container by changing the volume of the container to remove a substance which may damage the contents.

Yet another advantage of the present invention is to provide a system and a method for changing a volume of a container which may have a first section insertable into a second section.

Another advantage of the present invention is to provide a system and a method for changing a volume of a container to preserve contents of the container.

A further advantage of the present invention is to provide a system and a method to change the size of a container from one size to a smaller size.

Additional features and advantages of the present invention are described in, and will be apparent from, the detailed description of the presently preferred embodiments and from the drawings.

DETAILED DESCRIPTION OF THE PREFERRED EMBODIMENTS

The present invention relates to an apparatus, a system and a method for changing a volume. More specifically, the present invention relates to a system and a method for changing a volume of a container. The container may have a height defined by a top end and a bottom end. The container may have a number of sections and/or a number of portions which may connect, may secure and/or may attach to form the height of the container. Each section and/or each portion may have an inner surface and an outer surface. The inner surface of each portion and/or each section may define the volume of the container between the top end and the bottom end of the container. The container may hold and/or may store contents, for example, solids, gases and/or liquids within the volume of the container.

An environment external to the container may be separated from the volume of the container by the outer surface of the container. The environment may be the atmosphere, air, water and/or the like. The contents of the container may be used and/or removed from the volume of the container. As a result, an amount of the environment may fill and/or may enter the volume of the container. Each section and/or each portion of the container may be movable to change the height and/or to change the volume of the container. For example, a first section may be insertable into a second section to decrease the size, the height and/or the volume of the container. Changing the volume of the container may remove at least a portion of the amount of environment that previously entered the container.

Figure 1:
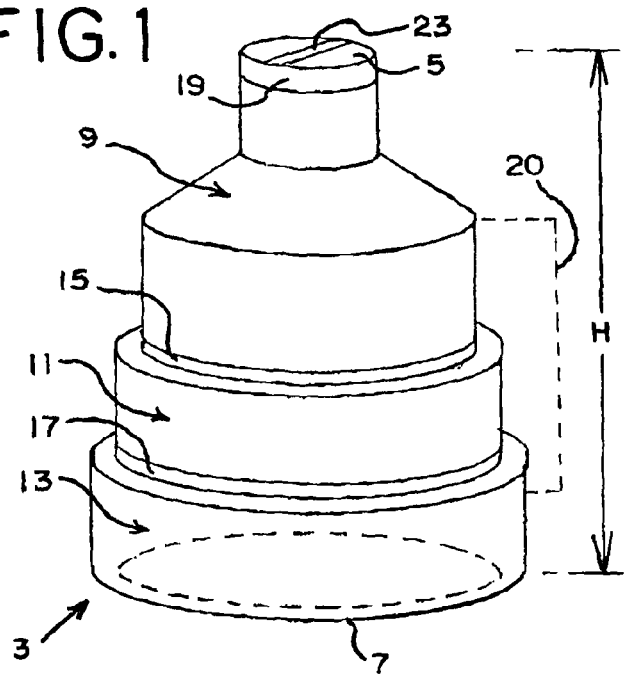
FIG. 1 illustrates a side plan view of an apparatus and a system for changing a volume of the same in an embodiment of the present invention.
Figure 2:
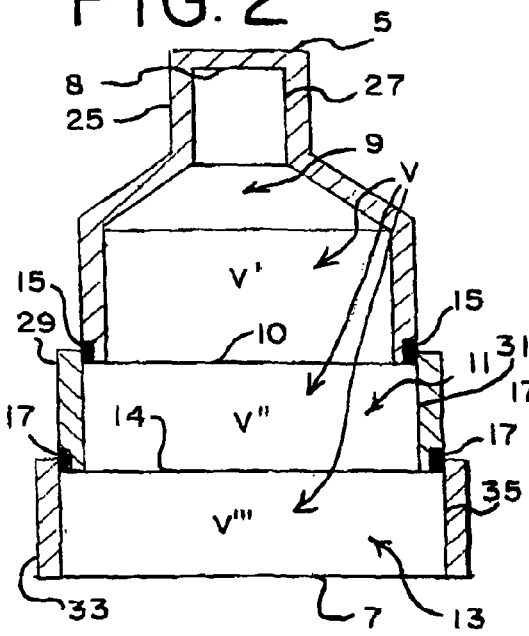
FIG. 2 illustrates a perspective view of a container in an embodiment of the present invention.

Referring now to the drawings wherein like numerals refer to like parts, FIG. 1 illustrates a container 3 which may have a first section 9, a second section 11 and/or a third section 13. The container 3 may have a height, H, defined between a top end 5 and a bottom end 7. The top end 5 may be opposite to the bottom end 7. The first section 9 of the container 3 may have an exterior surface 25 and an interior surface 27, as illustrated in FIG. 2. The second section 11 of the container 3 may have an exterior surface 29 and an interior surface 31. The third section 13 of the container 3 may have an exterior surface 33 and an interior surface 35. The exterior surfaces 25,29,33 may separate an environment external to the container 3 from the volume V of the container 3. The environment may be, for example, the atmosphere, liquids, gases and/or solids.

The volume V of the container 3 may store and/or may hold contents (not shown), such as, for example, solids, liquids and/or gases. The container 3 may be, for example, a soda bottle which may hold, for example, soda and/or air within the volume V. As other examples, the container 3 may be, for example, a bottle, a can, a jug and/or the like. The container 3 may hold, for example, water, juice, soda, paint, milk and/or the like.

Referring now to FIG. 2, a first ring 15 may be located and/or positioned between the first section 9 and the second section 11 of the container 3. The first ring 15 may be integrally formed with the first section 9 and/or the second section 11 of the container 3. The second section 11 may be removably attached to and/or may be connected to the third section 13 of the container 3 by a second ring 17. The rings 15,17 may be used for removeably sealing and/or removeably connecting the sections 9,11,13. The present invention should not be limited to a specific number of sections of the container 3 and/or a specific number of rings. It should be understood that the container 3 may be any number of sections and/or any number of rings as known to one of ordinary skill in the art.

The first ring 15 and/or the second ring 17 may seal the interior surfaces 27,31 from the exterior surfaces 25,29. The first ring 15 and/or the second ring 17 may be, for example, an o-ring, a rubber gasket, a washer and/or the like. The rings 15,17 may be made from, for example, rubber, silicone, latex, and/or the like. The first section 9 may be inserted within the container 3 toward the bottom end 7 of the container 3. The first ring 15 may seal and/or may be positioned between the interior surface 31 of the second section 11 and the exterior surface 25 of the first section 9. The first section 9 may be inserted within the container 3 and may removably attach to the interior surface 31 of the second section 11. The second section 11 may insert into the third section 13 and may seal and/or removably attach to the interior surface 35 of the third section 13.

The container 3 may be enclosed by a cap 19 which may secure to, may connect to and/or may removably attach to the top end 5 of the container 3. The cap 19 may prevent contents within the volume V of the container 3 from leaking and/or exiting from the container 3. The cap 19 may screw, may snap and/or may twist onto the top end 5 of the container 3.

The cap 5 may have a vent 23. The vent 23 may function as a one-way valve. To this end, the vent 23 may have an opening that may extend from the interior surface 27 of the first section 9 through the exterior surface 25 of the container 3. The vent 23 may open to release the environment and/or the contents of the container 3. The vent 23 may prevent the environment from entering the container 3. The vent 23, therefore, provides communication from the interior surface 27 of the container 3 to release contents, i.e. the environment from within the container 3, from the interior to the exterior while preventing the environment to enter the container 3.

FIG. 2 illustrates a perspective view of the container 3 in an embodiment of the present invention. The inner surfaces 27,31,35 of the container 3 may hold and/or may store the contents of the container 3. The first section 9 of the container 3 may have a top end 8 and a bottom end 10 which may have a volume V'. The second section 11 may be located between the bottom end 10 of the first section 9 and a distal end 14. The second section may have a volume V". The third section 13 may be positioned between the distal end 14 of the second section and the bottom end 7 of the container 3. The third section 13 may have a volume V'". Adding volume V', volume V" and V'" may total the volume V of the container 3.

Figure 3:
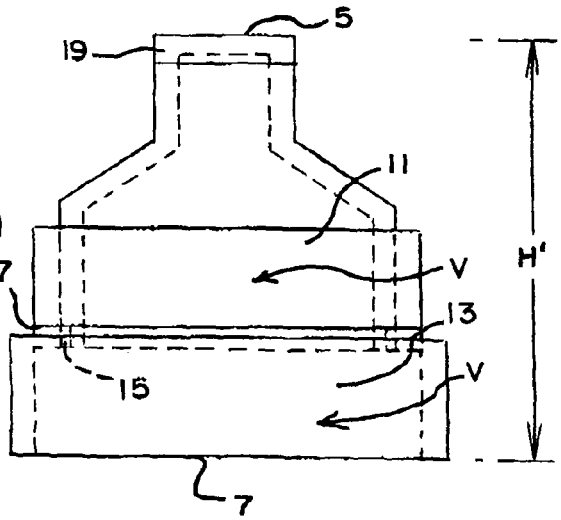
FIG. 3 illustrates a side plan view of a container with a first ring and a second ring in an embodiment of the present invention.

FIG. 3 illustrates a side plan view of the container 3 in an embodiment of the present invention. The contents of the container 3 may be removed from the first section 9 of the container 3. As the contents of the first section 9 of the container 3 are emptied and/or removed, air may fill the volume V' of the first section 9. To remove the air from the interior of the container 3, the first section 9 may insert and/or may move into the second section 11. Accordingly, the volume V of the container 3 may be decreased to the volume V' of the first section 9 plus the volume V''' of the third section 13 of the container 3. Alternatively, the first section 9 may insert partially into the second section 11 to change the volume V of the container 3. The height H of the container 3 may decrease to a smaller height H'.

Air, for example, from the environment may be removed from the container 3 by the vent 23 and/or by removing the cap 19 to allow the air to be removed through the top end 5 of the container 3. The air may be forced and/or pushed from the interior of the container 3 as the first section 9 is inserted into the second section 11. Likewise, the second section 11 may be depressed and/or inserted into the third section 13 to change the volume V of the container 3.

Figure 4A:
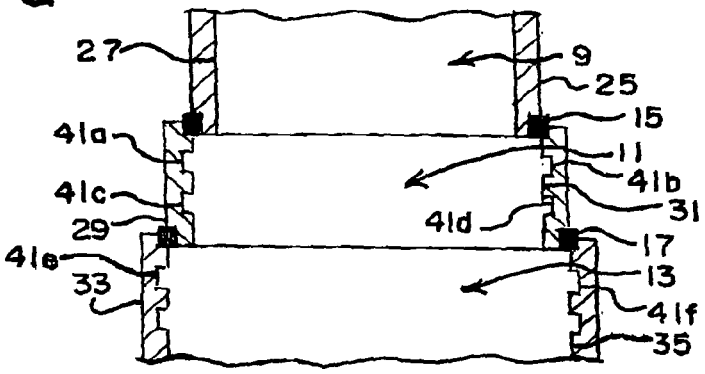
FIG. 4*a* illustrates a cross-sectional view of a section of a container having a ring in an embodiment of the present invention.
Figure 4B:
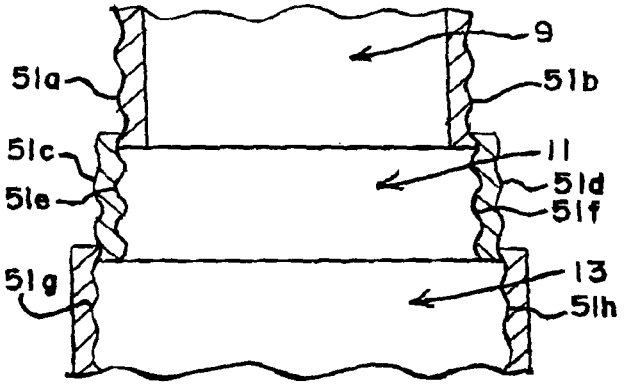
FIG. 4*b* illustrates a cross-sectional view of a section of a container having threads in an embodiment of the present invention.
Figure 4C:
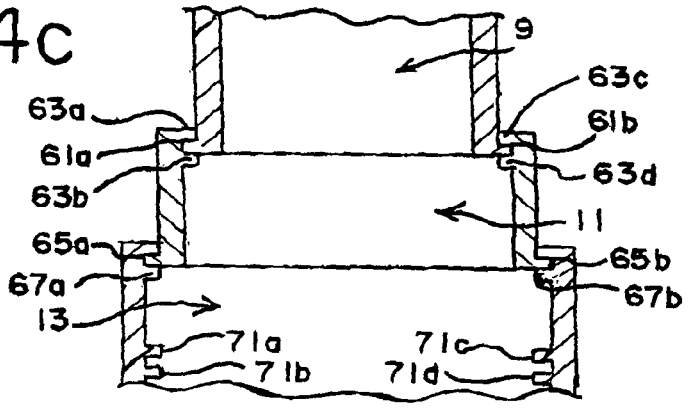
FIG. 4*c* illustrates a cross-sectional view of a section of a container having lips and notches in an embodiment of the present invention.

FIGS. 4*a*-4*c* illustrate cross-sectional views of embodiments of a section 20 of the container 3. The section 20, as illustrated in FIG. 1, may be one or more of the embodiments illustrated in FIGS. 4*a*-4*c*. FIG. 4*a* illustrates an embodiment of the section 20 having the first ring 15 and the second ring 17. The first ring 15 of the first section 9 may seal the first section 9 from the second section 11. The second ring 17 may seal to the first section 9 and/or the second section 11 from the third section 13.

The interior surfaces 31,35 of the container 3 may have indentations 41*a*-41*f* which may be, for example, grooves, depressions, creases and/or the like. The indentations 41*a*-41*f* may be formed within the interior surface 31 of the second section 11 and/or the interior surface 35 of the third section 13. The indentations 41*a*-41*f* may secure and/or may position the first ring 15 and/or the second ring 17.

FIG. 4*b* illustrates a cross-sectional view of the section 20 in an embodiment of the container 3 having threads 51*a*-51*h*. The threads 51*a*-51*h* may be, for example, straight threads, tapered threads, flared threads and/or the like. The first section 9 may have threads 51*a*, 51*b* integrally formed with the exterior surface 25 of the first section 9. The threads 51*a*, 51*b* may engage the threads 51*e*, 51*f* which may integrally formed with the interior surface 31 of the second section 11. The threads 51*c*, 51*d* may be integrally formed with the exterior surface 29 of the second section 11. The threads 51*c*, 51*d* may engage the threads 51*g*, 51*h*. The second section 11 may twist and/or may screw into and/or from the first section 9 and/or the third section 13. The first section 9 and/or the third section 13 may screw into and/or from the second section 11.

FIG. 4*c* illustrates a cross-sectional view of the section 20 in an embodiment of the container 3. The first section 9 may insert into the second section 11. Lips 61*a*, 61*b* may be positioned and/or located between the first section 9 and the second section 11. The lips 61*a*, 61*b* may be integrally formed to the first section 9 and/or the second section 11. The lips 61*a*, 61*b* may fit into and/or be positioned within notches 63*a*-63*d* to seal the first section 9 from the second section 11. The lips 61*a*, 61*b* of the first section 9 may be separated from the notches 63*a*, 63*b* and/or the notches 63*c*, 63*d* of the first section 9 by, for example, twisting, rotating, pushing and/or squeezing the first section 9.

Lips 65*a*, 65*b* may be integrally formed with the exterior surface 29 of the second section 11. The lips 65*a*, 65*b* may fit into and/or be located within notches 67*a*-67*d* and/or notches 71*a*-71*d* of the third section 13.

In an embodiment, the first section 9 may rotate with respect to the second section 11 to separate the lips 61*a*, 61*b* from the notches 63*a*-63*d*. The lips 61*a*, 61*b* may be integrally formed with the exterior surface 25 of the first section 9. The first section 9 may insert into the second section 11. The lips 61*a*, 61*b* of the first section 9 may fit within the notches 63*a*, 63*b* of the second section 11 by rotating the first section 9 with respect to the second section 11.

The container 3 may have the sections 9, 11, 13 which may be movable to change the volume V of the container 3. Contents may be stored and/or may be contained within the container 3. The first section 9 may insert into the second section 11 and/or the third section 13. The second section 11 and/or the third section 13 may secure to and/or may attach to the first section 9. As contents are removed from the first section 9 of the container 3, the environment may fill and/or may enter the volume of the container 3. The volume V of the container 3 may be decreased to remove the environment from the container 3 through the top end 5 and/or the vent 23.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An apparatus for storing contents within an adjustable volume to remove air from the adjustable volume to preserve the contents, the apparatus comprising:

a first section having a top end and a bottom end wherein the bottom end is opposite to the top end wherein the first section has an interior surface and an exterior surface and further wherein the first section has a first volume to store the contents wherein the first volume is defined between the top end, the bottom end and the interior surface;

a second section connected to the first section wherein the second section has a distal end and a proximate end wherein the second section has an outer surface and an inner surface wherein the second section has a second volume to store the contents wherein the first section and the second section have a height defined between the top end of the first section and the distal end of the second section wherein the first volume of the first section and the second volume of the second section form the adjustable volume for storing the contents wherein the height and the adjustable volume are modified by moving the bottom end of the first section to any one of an infinite number of positions between the proximate end and the distal end of the second section wherein the adjustable volume is increased by moving the bottom end of the first section away from the distal end of the second section wherein the adjustable volume is decreased by moving the bottom end of the first section toward the distal end of the second section;

a seal between the first section and the second section wherein the seal remains in place while positioning the first section between the proximate end and the distal end of the second section and at any one of the infinite number of positions between the proximate end and the distal end of the second section wherein the outer surface of the first section remains sealed with the inner surface of the second section at any one of the infinite number of positions between the proximate end and the distal end of the second section and further wherein the seal maintains any one of the infinite number of positions of the bottom end of the first section between the proximate end and the distal end of the second section; and a removable cap secured to the top end of the first section to close the top end of the first section wherein the removable cap has a vent that operates as a one-way valve to expel air from the adjustable volume through the vent as the adjustable volume is decreased.

2. The apparatus of claim 1 further comprising:

a ring forming the seal between the first section and the second section wherein the ring is constructed from one of the group consisting of rubber, silicone and latex.

3. The apparatus of claim 1 further comprising:

a third section connected to the second section.

4. A system for storing contents within a volume wherein the volume is decreased to remove air from the volume to reduce exposure of the contents to the air, the system comprising:

a container having an initial height defined between a top end of the container and a bottom end of the container wherein the container has a first section, a second section and a third section positioned between the top end of the container and the bottom end of the container wherein the second section is sized to removably attach to the first section wherein the third section is sized to removably attach to the first section and the second section and further wherein the first section is positioned at and held in place at any one of an infinite number of positions with respect to the second section and further wherein the second section is positioned at and held in place at any one of an infinite number of positions with respect to the third section;

a first ring between the first section and the second section to seal the first section to the second section and to hold the first section in place at any one of the infinite number of positions with respect to the second section wherein the first ring seals the first section to the second section at any one of the infinite number of positions with respect to the second section;

a second ring between the second section and the third section to seal the second section to the third section and to hold the first section in place at any one of the infinite number of positions with respect to the third section wherein the second ring seals the second section to the third section at any one of the infinite number of positions with respect to the third section; and a removable cap secured to the top end of the container to close the top end of the container wherein the removable cap has a vent that operates as a one-way valve to expel air from the container through the vent as the volume of the container is decreased.

5. The system of claim 4 wherein the first ring and the second ring are selected from one of the group consisting of an O-ring, a gasket and a washer.

6. The system of claim 4 wherein the first ring and the second ring are integral with the second section so that the position of the first ring and the second ring relative to the second section is maintained when the first section is positioned with respect to the second section and when the second section is positioned with respect to the third section.

7. The system of claim 6 wherein the first ring and the second ring are located at opposite ends of the second section.

8. The system of claim 4 wherein the first ring is between an inner surface of the first section and an outer surface of the second section and further wherein the second ring is between an inner surface of the second section and an outer surface of the third section.

9. An apparatus for storing contents within an adjustable volume to remove air from the adjustable volume to preserve the contents, the apparatus comprising:

a first section having a top end and a bottom end wherein the bottom end is opposite to the top end wherein the first section has an interior surface and an exterior surface and further wherein the first section has a first volume to store the contents wherein the first volume is defined between the top end, the bottom end and the interior surface;

a second section connected to the first section wherein the second section has a distal end and a proximate end wherein the second section has an outer surface and an inner surface wherein the second section has a second volume to store the contents wherein the first section and the second section have a height defined between the top end of the first section and the distal end of the second section wherein the first volume of the first section and the second volume of the second section form the adjustable volume for storing the contents wherein the height and the adjustable volume are modified by moving the bottom end of the first section to any one of an infinite number of positions between the proximate end and the distal end of the second section wherein the adjustable volume is increased by moving the bottom end of the first section away from the distal end of the second section wherein the adjustable volume is decreased by moving the bottom end of the first section toward the distal end of the second section; and a seal between the first section and the second section wherein the seal remains in place while positioning the first section between the proximate end and the distal end of the second section and at any one of the infinite number of positions between the proximate end and the distal end of the second section wherein the outer surface of the first section remains sealed with the inner surface of the second section at any one of the infinite number of positions between the proximate end and the distal end of the second section and further wherein the seal maintains any one of the infinite number of positions of the bottom end of the first section between the proximate end and the distal end of the second section, wherein the seal is integral with the bottom end of the first section and wherein the inner surface of the second section which is contacted by the seal is flat.

10. The apparatus of claim 9 further comprising:

a ring forming the seal between the first section and the second section wherein the ring is constructed from one of the group consisting of rubber, silicone and latex.

11. The apparatus of claim 9 further comprising:

a third section connected to the second section.

12. An apparatus for storing contents within an adjustable volume to remove air from the adjustable volume to preserve the contents, the apparatus comprising:

a first section having a top end and a bottom end wherein the bottom end is opposite to the top end wherein the first section has an interior surface and an exterior surface and further wherein the first section has a first volume to store the contents wherein the first volume is defined between the top end, the bottom end and the interior surface;

a second section connected to the first section wherein the second section has a distal end and a proximate end wherein the second section has an outer surface and an inner surface wherein the second section has a second volume to store the contents wherein the first section and the second section have a height defined between the top end of the first section and the distal end of the second section wherein the first volume of the first section and the second volume of the second section form the adjustable volume for storing the contents wherein the height and the adjustable volume are modified by moving the bottom end of the first section to any one of an infinite number of positions between the proximate end and the distal end of the second section wherein the adjustable volume is increased by moving the bottom end of the first section away from the distal end of the second section wherein the adjustable volume is decreased by moving the bottom end of the first section toward the distal end of the second section; and a seal between the first section and the second section wherein the seal remains in place while positioning the first section between the proximate end and the distal end of the second section and at any one of the infinite number of positions between the proximate end and the distal end of the second section wherein the outer surface of the first section remains sealed with the inner surface of the second section at any one of the infinite number of positions between the proximate end and the distal end of the second section and further wherein the seal maintains any one of the infinite number of positions of the bottom end of the first section between the proximate end and the distal end of the second section, wherein the seal is integral with the proximate end of the second section and wherein the exterior surface of the first section which is contacted by the seal is flat.

13. The apparatus of claim 12 further comprising:

a ring forming the seal between the first section and the second section wherein the ring is constructed from one of the group consisting of rubber, silicone and latex.

14. The apparatus of claim 12 further comprising:

a third section connected to the second section.

15. A method for storing contents within an adjustable volume to remove air from the adjustable volume to preserve the contents, the method comprising:

providing an apparatus having a first section having a top end and a bottom end wherein the bottom end is opposite to the top end wherein the first section has an interior surface and an exterior surface and further wherein the first section has a first volume to store the contents wherein the first volume is defined between the top end, the bottom end and the interior surface;

providing a second section of the apparatus connected to the first section of the apparatus wherein the second section has a distal end and a proximate end wherein the second section has an outer surface and an inner surface wherein the second section has a second volume to store the contents wherein the first section and the second section have a height defined between the top end of the first section and the distal end of the second section wherein the first volume of the first section and the second volume of the second section form the adjustable volume for storing the contents wherein the height and the adjustable volume are modified by moving the bottom end of the first section to any one of an infinite number of positions between the proximate end and the distal end of the second section wherein the adjustable volume is increased by moving the bottom end of the first section away from the distal end of the second section wherein the adjustable volume is decreased by moving the bottom end of the first section toward the distal end of the second section;

providing a seal between the first section of the apparatus and the second section of the apparatus; and positioning the first section of the apparatus between the proximate end and the distal end of the second section of the apparatus and at any one of the infinite number of positions between the proximate end and the distal end of the second section of the apparatus wherein the seal remains in place relative to one of the first section and the second section while positioning the first section and further wherein the seal connects the bottom end of the first section to the second section to maintain position and seal with any one of the infinite number of positions between the proximate end and the distal end of the second section.

16. The method of claim 15 wherein the seal remains in place relative to the first section while positioning the first section and further wherein the seal moves relative to the second section while positioning the first section.

17. The method of claim 15 wherein the seal remains in place relative to the second section while positioning the first section and further wherein the seal moves relative to the first section while positioning the first section.

18. The method of claim 15 further comprising: sealing the container by attaching a cap to the top end of the container.

19. The method of claim 18 further comprising: removing the cap from the top end of the container.

20. The method of claim 19 wherein the cap is attached to the top end of the container and removed from the top end of the container by twisting the cap.

* * * * *